US008844620B2

(12) United States Patent
Gregurek et al.

(10) Patent No.: US 8,844,620 B2
(45) Date of Patent: Sep. 30, 2014

(54) SIDE-TRACKING SYSTEM AND RELATED METHODS

(75) Inventors: Philip M. Gregurek, Houston, TX (US); Charles H. Dewey, Houston, TX (US)

(73) Assignee: Smith International, Inc., Houston, TX (US)

( * ) Notice: Subject to any disclaimer, the term of this patent is extended or adjusted under 35 U.S.C. 154(b) by 761 days.

(21) Appl. No.: 12/979,842

(22) Filed: Dec. 28, 2010

(65) Prior Publication Data

US 2011/0155468 A1 Jun. 30, 2011

Related U.S. Application Data

(60) Provisional application No. 61/291,815, filed on Dec. 31, 2009.

(51) Int. Cl.
*E21B 7/06* (2006.01)

(52) U.S. Cl.
CPC ..... *E21B 7/061* (2013.01)
USPC ..... 166/117.5; 166/117.6; 175/81; 175/325.2

(58) Field of Classification Search
USPC ..... 175/257, 258, 263, 284, 399, 398, 79, 175/61, 73, 81, 117.5, 117.6, 325.2
See application file for complete search history.

(56) References Cited

U.S. PATENT DOCUMENTS

| | | | | | |
|---|---|---|---|---|---|
| 2,498,159 | A * | 2/1950 | Gammill | ..... | 175/82 |
| 2,553,874 | A * | 5/1951 | Spaulding et al. | ..... | 175/82 |
| 4,765,404 | A * | 8/1988 | Bailey et al. | ..... | 166/117.6 |
| 5,361,833 | A * | 11/1994 | Schock et al. | ..... | 166/117.6 |
| 5,771,972 | A | 6/1998 | Dewey et al. | | |
| 5,826,651 | A | 10/1998 | Lee et al. | | |
| 5,887,668 | A * | 3/1999 | Haugen et al. | ..... | 175/79 |
| 5,894,889 | A | 4/1999 | Dewey et al. | | |
| 6,050,334 | A * | 4/2000 | McGarian et al. | ..... | 166/117.6 |
| 6,102,123 | A | 8/2000 | Bailey et al. | | |
| 6,464,002 | B1 * | 10/2002 | Hart et al. | ..... | 166/117.6 |
| 6,581,699 | B1 | 6/2003 | Chen et al. | | |
| 6,612,383 | B2 * | 9/2003 | Desai et al. | ..... | 175/61 |
| 6,648,068 | B2 | 11/2003 | Dewey et al. | | |
| 7,178,589 | B2 | 2/2007 | Campbell et al. | | |
| 7,207,401 | B2 | 4/2007 | Dewey et al. | | |
| 2005/0039905 | A1 * | 2/2005 | Hart et al. | ..... | 166/55.7 |
| 2009/0133877 | A1 | 5/2009 | Neff | | |

OTHER PUBLICATIONS

International Search Report and Written Opinion issued in corresponding International Application No. PCT/US2010/062511; Dated Aug. 31, 2011 (10 pages).

* cited by examiner

*Primary Examiner* — David Andrews
*Assistant Examiner* — Ronald Runyan
(74) *Attorney, Agent, or Firm* — Osha Liang LLP

(57) ABSTRACT

A sidetracking tool includes a setting tool having an expandable anchor, a whipstock connected to an upper end of the setting tool, the whipstock having a ramp face along an axial length thereof, and a drilling assembly including a drill bit disposed on an end thereof, wherein the drill bit is configured to interface with the ramp face of the whipstock.

23 Claims, 4 Drawing Sheets

SIDE-TRACKING SYSTEM AND RELATED METHODS

CROSS-REFERENCE TO RELATED APPLICATIONS

This application, pursuant to 35 U.S.C. §119(e), claims priority to U.S. Provisional Application Ser. No. 61/291,815, filed Dec. 31, 2009, and which is incorporated herein by reference in its entirety.

BACKGROUND

1. Field of the Disclosure

Embodiments disclosed herein relate generally to downhole tools. In particular, embodiments disclosed herein relate to methods and assemblies for drilling a deviated secondary borehole from an existing borehole in geologic formations.

2. Background Art

Traditionally, whipstocks have been used to drill a deviated borehole from an existing earth borehole. The whipstock has a ramp surface which is set in a predetermined position to guide the drill bit on the drill string in a deviated manner to drill into the side of the earth borehole until a secondary borehole is established branching from the existing borehole. In operation, the whipstock is located at a desired depth in the existing borehole by one of several techniques (combined with an anchor or packer that can be set to a desired location in a borehole, set on bottom, or set on plug, etc.), the whipstock is then surveyed when at the desired depth so that the whipstock face can be oriented azimuthally. Then the drill string is lowered into the well and the whipstock serves to deflect or urge the drill bit into the side wall of the bore hole at the angle of the ramp on the whipstock. As the drill string progresses, a secondary borehole is drilled that deviates or branches from the existing borehole. This process of drilling a deviated secondary borehole from an existing borehole is also called "sidetracking." And more specifically, it may be referred to as open-hole sidetracking when the existing borehole is uncased, that is, the side-tracking initiates directly into the earth formation side wall of the existing borehole.

The typical open-hole sidetracking operation requires at least two trips. The first trip generally involves orienting and setting the whipstock in the open borehole. The second trip generally involves going back into the hole with the bottom-hole-assembly (BHA) with a conventional drill bit to drill the deviated secondary borehole. It is also common that an open hole-side tracking operation requires more than two trips. The anchor or packer may be set in one trip without the presence of the whipstock which is then oriented and set in a separate trip. Or there may be issues with initiating the deviated borehole which requires multiple trips to get started. In general, the elimination of "trips" to accomplish an operation is desirable as each "trip" of the drill string or work string in and out of a well is timely which results in delay and higher drilling costs.

It is also common to drill deviated boreholes from a cased borehole—known as cased-hole sidetracking. The following patents, commonly owned by the current assignee, disclose systems for one-trip milling of cased-hole deviated boreholes: U.S. Pat. Nos. 5,771,972; 5,894,889; 6,102,123; 6,648,068; and 7,207,401. This family of patents also discloses a method that allows "drilling ahead" into the formation further than the typical rat-hole and preferably to the desired target depth ("TD") of the customer. The configuration and design of the mills that are used to "drill ahead" are a balance of being able to handle the challenging demands of milling the window in the casing and being able to drill to TD with a reasonable rate of penetration ("ROP"). As such, the mills used in these cased-hole sidetracking systems have not been conventional drill bits that, in conventional drilling, are selected or designed to focus on the efficient drilling of the particular lithologies of the earth formation expected to be encountered while drilling to TD.

Accordingly, there exists a need for a one-trip sidetracking tool for sidetracking operations in uncased boreholes.

SUMMARY OF THE DISCLOSURE

In one aspect, embodiments disclosed herein relate to a sidetracking tool including a setting tool having an expandable anchor, a whipstock connected to an upper end of the setting tool, the whipstock having a ramp face along an axial length thereof, and a drilling assembly including a drill bit disposed on an end thereof, wherein the drill bit is configured to interface with the ramp face of the whipstock.

In other aspects, embodiments disclosed herein relate to a method of sidetracking including running a sidetracking tool into a borehole, the sidetracking tool including a setting tool having an expandable anchor, a whipstock having a ramp face along an axial length thereof, and a drilling assembly having a drill bit disposed on an end thereof, wherein the drill bit is connected to an upper end of the whipstock. The method further includes actuating the expandable anchor and securing the sidetracking tool in the borehole, applying weight on the drilling assembly and shearing at least one shear screw connecting the drill bit and the upper end of the whipstock, rotating and translating the drill bit downward along an axial length of the ramp face of the whipstock, and deviating the drill bit in a radially outward direction and contacting a sidewall of the borehole to drill deviated hole.

Other aspects and advantages of the invention will be apparent from the following description and the appended claims.

DETAILED DESCRIPTION

Figure 1A:
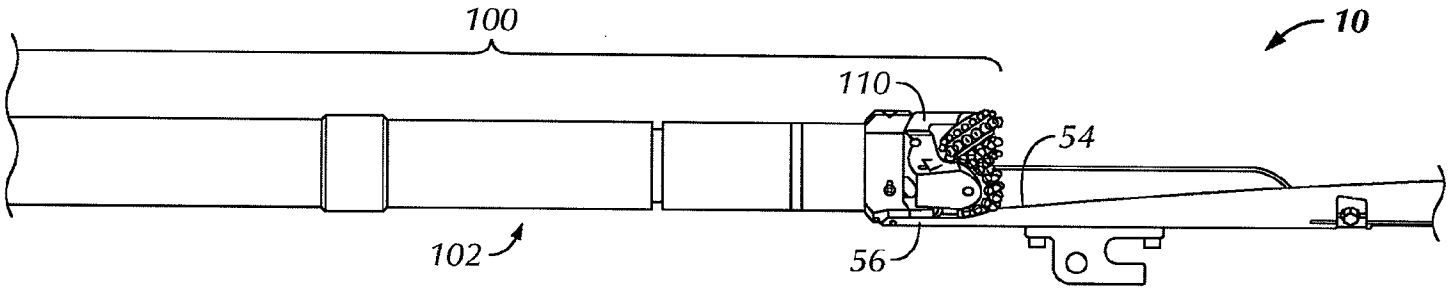
FIGS. 1A-1C, when viewed end to end, depict a side view of the sidetracking assembly in accordance with one or more embodiments of the present disclosure.
Figure 1B:
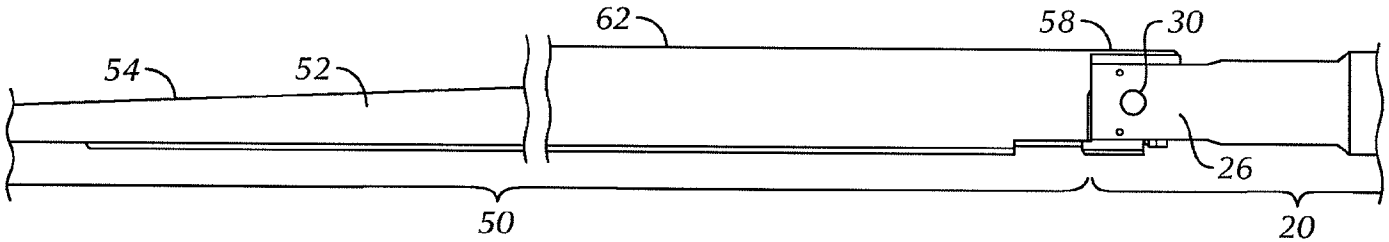
Figure 1C:
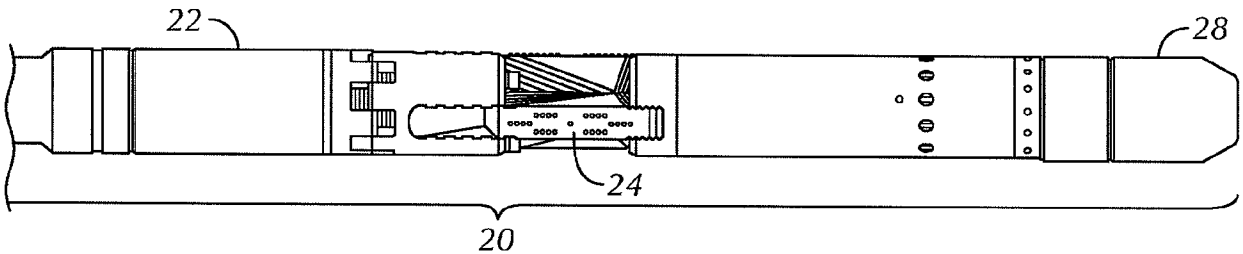

In one aspect, embodiments disclosed herein relate to a one-trip sidetracking system for sidetracking operations in uncased boreholes. Referring initially to FIGS. 1A-1C, side views of a one-trip sidetracking assembly 10 for open-hole (i.e., uncased borehole) sidetracking in accordance with one or more embodiments of the present disclosure are shown. Sidetracking assembly 10 includes a setting assembly 20 for engagement with a borehole sidewall (not shown) to locate sidetracking assembly 10 at the desired location in the borehole (not shown), a whipstock assembly 50, which provides ramp face 54 for deviating subsequent drilling and is connected at its bottom to setting assembly 20, and a drilling assembly 100, which includes a bottom-hole-assembly ("BHA") 102 including a drill bit 110 attached to the top of whipstock assembly 50. In other embodiments, the BHA may include one or more of a drill bit, a drill collar, a stabilizer, a reamer, a positive displacement motor, a rotary steering tool, measurement-while-drilling sensors, and any other device useful in subterranean drilling.

Setting assembly 20 includes an anchor 22 which may be of the type disclosed in U.S. Pat. No. 7,178,589, which is incorporated herein by reference for all purposes. Anchor 22 may be configured having a large ratio of expanded diameter to unexpanded diameter, which makes it suitable for engaging with the borehole sidewall. Anchor 22 includes a plurality of slips 24, which are expandable from a running position (i.e., unexpanded) to an anchoring position (i.e., expanded). Anchor 22 has a diameter that is sufficiently less than the diameter of a borehole (not shown) to allow anchor 22 to be lowered through the borehole, yet large enough such that expandable slips 24 can be expanded to a diameter to fully engage the borehole. Slips 24 may be hydraulically set by operation of a piston. As the piston is translated by hydraulic pressure, it forces slips 24 to slide on angled ramps (not shown) to extend radially outward until slips 24 engage the borehole side wall sufficiently to anchor sidetracking assembly 10 at a desired location in the borehole.

In alternate embodiments, other devices may be used for setting assembly 20, for example, other types of anchors, packers, which seal the annulus around the packer in addition to anchoring, or some type of device that locks, locates, or sets into a pre-existing structure in the borehole, for example, bridge plugs, plugs of cement, bottom of borehole casing, which remains after a length of casing has been milled away, or some other type of sleeve located in the borehole as will be understood by those skilled in the art.

Anchor 22 has upper end 26, which is connected to bottom end 58 of whipstock 50 at pivot joint 30. Bottom end 28 is opposite of upper end 26 and may be suspended in the borehole below slips 24 when slips 24 are set into engagement with the borehole side wall. If some type of bottom set anchor or packer is used in setting assembly 20, the bottom end will include a mechanism, which may activate slips 24 when the bottom end 28 is pressed against an object in the borehole, e.g., the bottom of the borehole or a plug of some type. Anchor 22 includes a fluid passageway (not shown) which transmits hydraulic pressure to the internal piston that sets slips 24.

Figure 2:
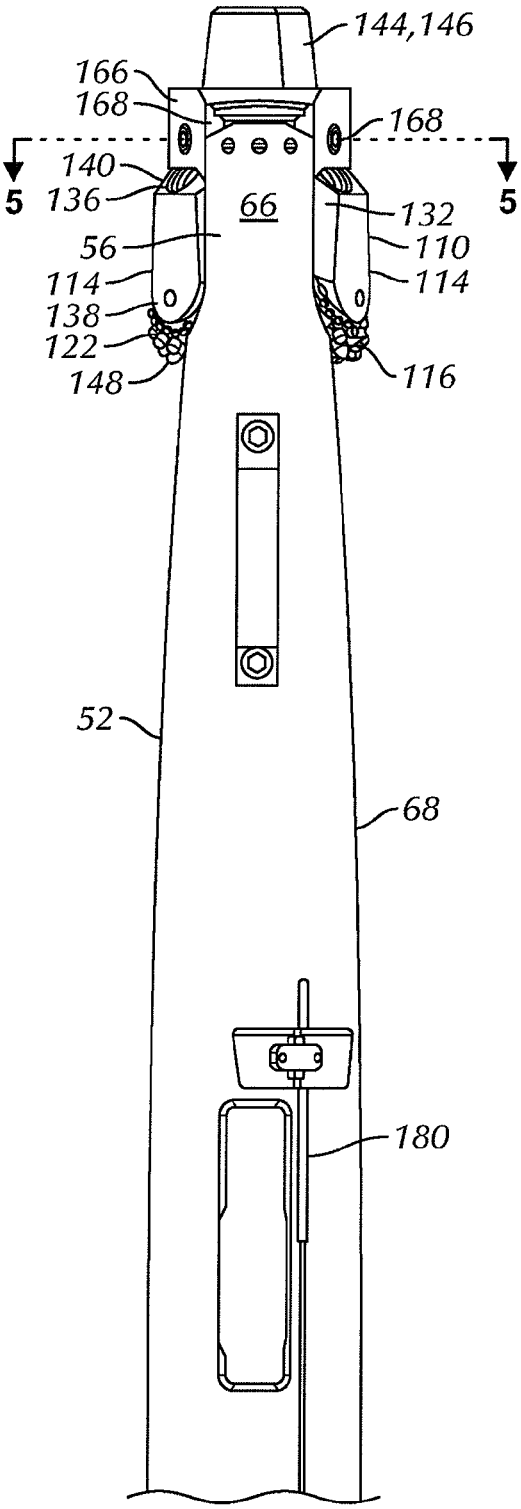
FIG. 2 is a first side view of the bit/whipstock subassembly in accordance with one or more embodiments of the present disclosure.
Figure 3:
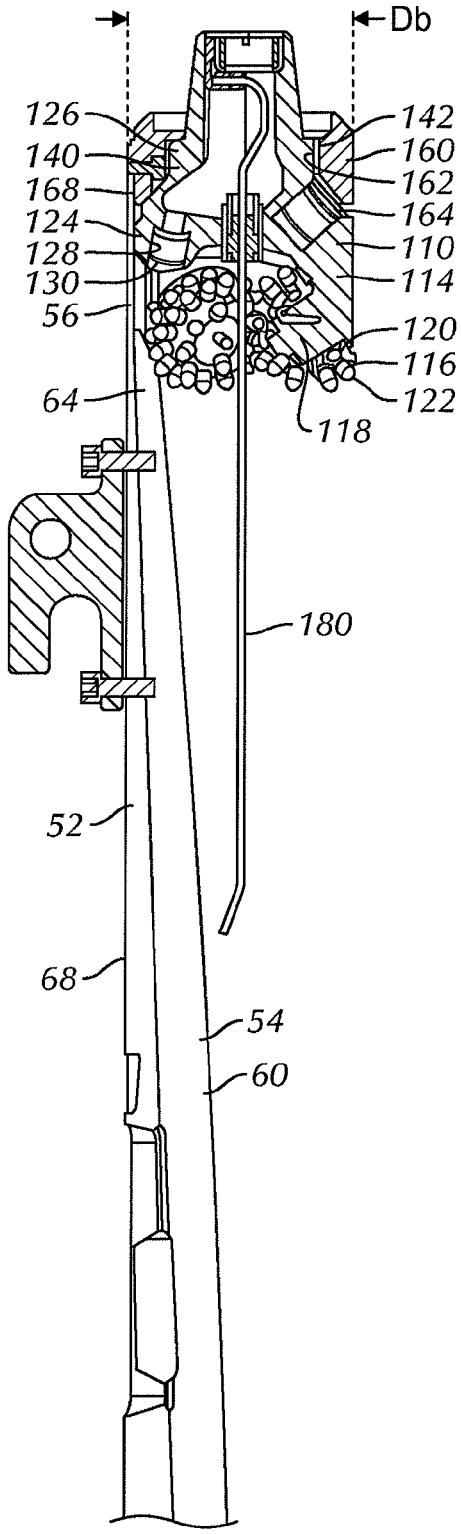
FIG. 3 is a second side view, with partial cross-section, of the bit/whipstock subassembly in accordance with one or more embodiments of the present disclosure.
Figure 4:
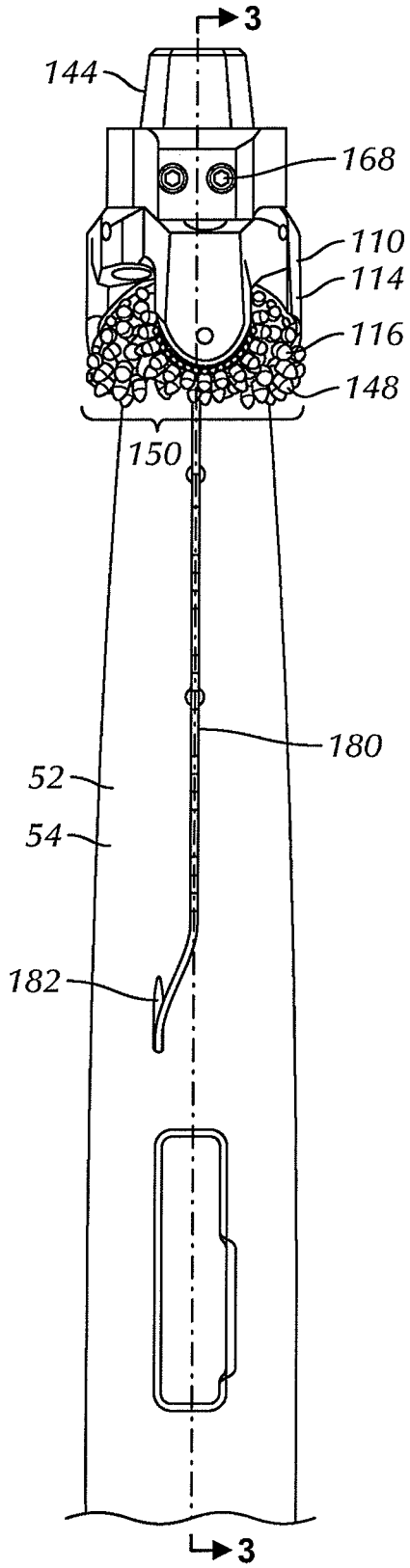
FIG. 4 is a third side view of the bit/whipstock assembly in accordance with one or more embodiments of the present disclosure.
Figure 5:
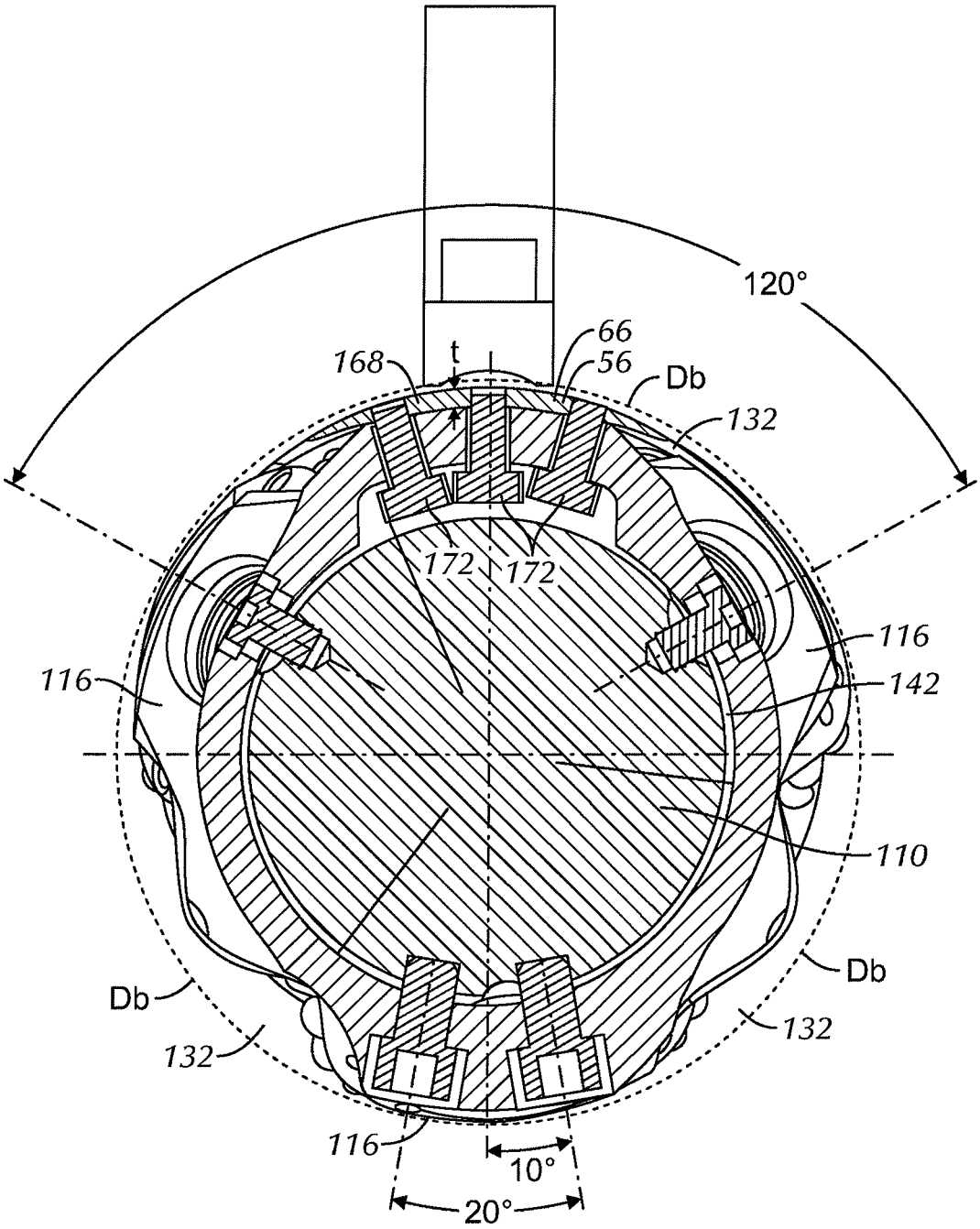
FIG. 5 is a cross-section through line 5-5 of FIG. 2.

Whipstock assembly 50 includes a whipstock 52 that has bottom end 58 connected at pivot joint 30 to upper end 26 of anchor 22. Whipstock 52 has a diameter that is small enough to allow whipstock 52 to be lowered through borehole 12 yet large enough to allow sufficient surface area of ramp face 54 to deviate a drill bit into the borehole sidewall. Whipstock 52 includes ramp face 54, which, in certain embodiments, may have a concave, arcuate cross-section. In alternate embodiments, the ramp face 54 may be configured having other cross-section shapes as understood by those skilled in the art. As shown in FIGS. 2-4, ramp face 54 has an arcuate surface 60 and extends from upper end 62 to lower end 64. In certain embodiments, the radius of curvature R of arcuate surface 60 is generally constant from upper end 62 to lower end 64 and is sized to generally match the radius of the diameter of drill bit 110. Further, ramp face 54 may have up to a 3 degree angle along a length thereof. Other embodiments may have other non-standard angles, as will be understood by those skilled in the art. Further, in certain embodiments, arcuate surface 60 of ramp face 54 may have a hardfacing applied thereon to increase its durability.

Referring now to FIGS. 2-5, multiple views of an interface between drill bit 110 and upper end 56 of whipstock 52 in accordance with one or more embodiments of the present disclosure are shown. Whipstock has upper end 56 especially adapted for connection to a conventional drill bit, which in certain embodiments, may be a roller cone bit. Drill bit 110 has legs 114 on which are mounted cones 116, which rotate on journals 118 extending from legs 114. Cones 116 have gage surface 120, which includes gage inserts 122, which extend to the gage of drill bit 110. Drill bit 110 has nozzle bosses 124, which extend outwardly from bit body 126 of drill bit 110. Nozzle bosses 124 have passageways 128, which are adapted to contain nozzles 130. Spaces 132 can be seen inside circumscribed diameter $D_b$ and between each pair of cones 116 and along nozzle bosses 124. Legs 114 have a shoulder end 136 at one end and shirt tail end 138 at the opposite end adjacent cone 116. Axially above shoulder ends 136, bit body 125 necks down to define neck 140, which has generally circumferential neck surface 142. Axially above neck surface 142 is a pin connection 144 with threads 146 extending from bit body 126.

Cones 116 also have additional inserts 148 mounted in addition to gage inserts 122. The arrangement of gage inserts 122 and additional inserts 148 together with the geometry of cones 116 and the arrangement and orientation of cones 116 on journals 118 relative to bit body 126 is collectively referred to as cutting structure 150. The cutting structure 150 is the portion of drill bit 150 that engages the earthen formation. The design of cutting structure 150 is complex and takes several considerations into account to optimize the design of cutting structure for a given type, or lithology, of earthen formation. For example, the number of inserts on cones 116 may change depending on the hardness of the formation. The angle of journals 118 relative to horizontal, as well as the offset of the journals relative to the centerline of drill bit 110 will also change depending on the type of formation and expected drilling parameters. So while the upper portions for a given diameter drill bit will largely be the same (e.g., pin connection 144, neck 140 and shoulder ends 136 of legs 114), the cutting structure 150 area of drill bit 110 may vary based on the application of the drill bit (e.g., geometry of cones 116, layout and count of inserts 122 and 148, and various relationships between the cones to drill bit body 126).

In other embodiments, a fixed-cutter bit (also called drag bits), which typically include a bit body 22 having a threaded connection at one end and a cutting head formed at the other end, may be disposed at an end of the drilling assembly. The head of the fixed-cutter bit typically includes a plurality of ribs or blades arranged about the rotational axis of the drill bit and extending radially outward from the bit body. Cutting elements are embedded in the raised ribs to cut formation as the drill bit is rotated on a bottom surface of a well bore. Cutting elements of fixed-cutter bits typically include polycrystalline diamond compacts ("PDC") or specially manufactured diamond cutters. These drill bits are also referred to as PDC bits.

Referring back to FIGS. 2-5, upper end 56 of whipstock 52 may be sized to fit within one of the spaces 132. In certain embodiments, upper end 56 may fit entirely within diameter $D_b$ and not extend beyond diameter $D_b$. As such, a full gage diameter (the gage diameter of drill bit 110 is the same as the diameter of the borehole) drill bit 110 may be used to create secondary borehole (not shown). Upper end 56 extends through space 132 and generally up to the same axial extent as shoulder ends 136 of legs 114. Collar 160 is generally of a ring shape with an inside diameter that is sized to fit over pin connection 144 and an outer diameter that is preferably no greater than the diameter of borehole and preferably less than such diameter to allow ease of passage through borehole. Collar 160 has an inside surface 162 that coincides with a neck surface 142 of neck 140. A plurality of connectors 168, e.g., screws, is used to secure collar 160 to neck 140 of drill bit 110. Inside surface 162 also has sloped portion 164, which is sized to nest onto shoulder ends 136 of legs 114.

Collar 160 has outer surface 166, which includes mating surface 168 onto which is mated upper end 56 of whipstock 52. Collar 160 is sized such that when finally mounted on drill bit 110, mating surface 168 is set off from diameter $D_b$ by a distance equal to or greater than the thickness t, of tongue 66 of upper end 64. In this way, upper end 56 of whipstock 52 does not extend radially beyond the diameter $D_b$ of drill bit 110. The extension of tongue 66 axially above cones 116 also may allow for a smooth, gradual engagement of drill bit 110 with ramp face 54 of whipstock 52 once the drill bit starts advancing down the borehole during operation. Further, tongue 66 of upper end 56 may be shaped to fit within one of the spaces 132 of drill bit 110 and adjacent mating surface 168 of collar 160. Tongue 66 may be attached to mating surface 168 with shear screws 172 which are designed to shear at a predetermined force, either up and/or down, applied to the drill string.

Referring to FIGS. 1-5, methods related to the sidetracking assembly disclosed herein include running the sidetracking assembly into the borehole to a specified or predetermined depth. When anchor 22 is set, hydraulic pressure is delivered through hydraulic line 180, which extends through bit 110 and along the upper end 64 of ramp face 54 and then passes through whipstock 52 at port 182 to travel down backside 68 of whipstock 52. Hydraulic line 180 is sacrificial and may be drilled away once drill bit 110 begins to drill and travel down ramp face 54. In this way, once anchor 22 has been set in the desired location, weight may be set on the drill string, or the drill string pulled, to shear the shear screws 172. Once shear screws 172 are sheared, drill bit 110 is free to begin rotating and translating down ramp face 54 of whipstock 52, which causes the drill bit 110 to deviate from outwardly in a radial direction toward the borehole sidewall. Initially, drill bit 110 will only slightly cut into the borehole sidewall and then will progressively cut further into the borehole sidewall as bit 110 progresses down ramp face 54 and is urged sideways into the borehole sidewall.

In certain alternate embodiments, the sidetracking assembly disclosed herein may be adapted for use in cased-hole sidetracking, or open-hole side tracking that involves more than one trip.

Advantageously, embodiments of the present disclosure provide a sidetracking assembly capable of fully performing sidetracking operations in a single trip into the borehole. Particularly, overall costs associated with the rig and drilling may be reduced because of the single trip required. In addition, the sidetracking assembly is able to use a conventional drill bit without having to modify the cutting structure of drill bit, which further reduces overall costs of the operation.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A sidetracking tool comprising:

a setting tool including an expandable anchor;

a whipstock connected to the setting tool, the whipstock including a ramp face along an axial length of the whipstock, and a single tongue at an upper end of the whipstock; and a drilling assembly including a drill bit disposed on an end thereof and releasably coupled to the whipstock, wherein the drill bit is configured to interface with the ramp face of the whipstock, and wherein the drill bit includes two adjacent blades or legs arranged such that a full width of the single tongue of the whipstock is disposed fully between the two adjacent blades or legs of the drill bit.

2. The sidetracking tool of claim 1, further comprising a hydraulic line that extends through the drill bit and along an axial length of the whipstock and is in fluid communication with the expandable anchor, wherein the expandable anchor is configured to become set within a borehole in response to an increase in hydraulic pressure through the hydraulic line.

3. The sidetracking tool of claim 2, wherein the expandable anchor includes an internal piston configured to expand a plurality of expandable slips of the expandable anchor in response to the increase in hydraulic pressure.

4. The sidetracking tool of claim 1, wherein the expandable anchor comprises a plurality of individual expandable slips configured to engage a borehole side wall.

5. The sidetracking tool of claim 1, further comprising at least one shear screw connecting the drill bit to the single tongue at the upper end of the whipstock.

6. The sidetracking tool of claim 5, wherein the at least one shear screw is configured to shear when weight is applied to the drilling assembly to allow the drill bit to begin rotating and translating down the ramp face of the whipstock.

7. The sidetracking tool of claim 1, wherein the ramp face of the whipstock has up to a 3 degree angle therealong.

8. The sidetracking tool of claim 1, wherein the ramp face of the whipstock has a concave arcuate cross-section.

9. The sidetracking tool of claim 1, wherein a radius of curvature of the ramp face of the whipstock substantially matches a radius of curvature of an exterior surface of the drill bit.

10. The sidetracking tool of claim 1, wherein the whipstock is pivotably connected to an upper end of the setting tool.

11. The sidetracking tool of claim 1, wherein the drill bit comprises a roller cone bit.

12. The sidetracking tool of claim 1, wherein the drill bit comprises a fixed cutter bit.

13. The sidetracking tool of claim 1, wherein the drilling assembly comprises a positive displacement motor.

14. The sidetracking tool of claim 1, wherein the drilling assembly comprises a rotary steerable system.

15. The sidetracking tool of claim 1, wherein the tongue of the whipstock extends axially above the two adjacent blades or legs of the drill bit.

16. The sidetracking tool of claim 1, further comprising a collar disposed around a pin connection of the drill bit, the collar connecting to the tongue of the whipstock.

17. The sidetracking tool of claim 1, wherein the tongue does not extend radially outward beyond a gage diameter of the drill bit.

18. A method of sidetracking comprising:

running a sidetracking tool into a borehole, the sidetracking tool comprising:

a setting tool comprising an expandable anchor;

a whipstock comprising:

a ramp face along an axial length of the whipstock; and a single tongue at an upper end of the whipstock; and a drilling assembly having a drill bit disposed on an end thereof, wherein the drill bit has two adjacent blades or legs and is connected to the upper end of the whipstock such that the single tongue is positioned fully between the two adjacent blades or legs and fully within a gage diameter of the drill bit;

actuating the expandable anchor and securing the sidetracking tool in the borehole;

shearing at least one shear screw connecting the drill bit and the single tongue at the upper end of the whipstock;

rotating the drill bit;

translating the drill bit downward along an axial length of the ramp face of the whipstock;

deviating the drill bit in a radially outward direction and contacting a sidewall of the borehole; and drilling a deviated borehole.

19. The method of claim 18, further comprising increasing hydraulic pressure through a hydraulic line in fluid communication with the expandable anchor.

20. The method of claim 18, wherein deviating the drill bit in a radially outward direction includes interfacing the drill bit with an arcuate, concave surface of the ramp face.

21. The method of claim 18, wherein actuating the expandable anchor includes expanding a plurality of individual slips of the expandable anchor to engage the sidewall of the borehole.

22. The method of claim 18, wherein the drill bit is a roller cone bit, and wherein the tongue has a width fully disposed between two adjacent legs of the roller cone bit.

23. The method of claim 18, wherein the drill bit is a fixed cutter bit, and wherein the tongue has a width fully disposed between two adjacent blades of the fixed cutter bit.

* * * * *